US007094271B2

(12) United States Patent
Götzinger et al.

(10) Patent No.: US 7,094,271 B2
(45) Date of Patent: Aug. 22, 2006

(54) METHOD FOR PRODUCING STAINLESS STEELS, IN PARTICULAR HIGH-GRADE STEELS CONTAINING CHROMIUM AND CHROMIUM-NICKEL

(75) Inventors: Karl Reiner Götzinger, Repelen (DE); Stefan Lemke, Witten (DE); Johann Reichel, Düsseldorf (DE); Bernt Rollinger, Taunusstein (DE)

(73) Assignee: SMS Demag AG, Düsseldorf (DE)

( * ) Notice: Subject to any disclaimer, the term of this patent is extended or adjusted under 35 U.S.C. 154(b) by 276 days.

(21) Appl. No.: 10/399,007

(22) PCT Filed: Sep. 27, 2001

(86) PCT No.: PCT/EP01/11190

§ 371 (c)(1),
(2), (4) Date: Jul. 21, 2003

(87) PCT Pub. No.: WO02/33130

PCT Pub. Date: Apr. 25, 2002

(65) Prior Publication Data

US 2004/0099091 A1 May 27, 2004

(30) Foreign Application Priority Data

| | | |
|---|---|---|
| Oct. 18, 2000 | (DE) | 100 51 803 |
| Mar. 29, 2001 | (DE) | 101 15 779 |
| Jul. 18, 2001 | (DE) | 101 34 880 |
| Aug. 1, 2001 | (DE) | 101 37 761 |

(51) Int. Cl.
*C21B 11/10* (2006.01)
*C21C 5/30* (2006.01)

(52) U.S. Cl. ..... 75/10.63; 75/543

(58) Field of Classification Search ..... 75/10.63, 75/10.5, 10.51, 543
See application file for complete search history.

(56) References Cited

U.S. PATENT DOCUMENTS

| | | | | |
|---|---|---|---|---|
| 2,430,131 A | | 11/1947 | Loveless | |
| 6,077,324 A | * | 6/2000 | Fritz | 75/10.12 |
| 6,238,453 B1 | * | 5/2001 | Rose et al. | 75/10.63 |
| 6,679,931 B1 | * | 1/2004 | Gotzinger et al. | 75/10.35 |

FOREIGN PATENT DOCUMENTS

| | | |
|---|---|---|
| DE | 196 21 143 A1 | 8/1997 |
| EP | 0721990 | 7/1996 |
| EP | 0889138 | 1/1999 |
| WO | 9535394 | 12/1995 |

* cited by examiner

*Primary Examiner*—Scott Kastler
(74) *Attorney, Agent, or Firm*—Friedrich Kueffner

(57) ABSTRACT

The invention relates to a method for producing stainless steels, in particular steels containing chromium and chromium-nickel. The method is carried out in a melting device containing a metallurgical vessel, or in a melting device (1) containing at least two vessels (2, 3) for supplying a steel-casting installation, an electric arc furnace process (1) and an air-refining process taking place alternately in the two vessels (2, 3). To improve the efficiency of a method of this type, the aim of the invention is to carry out a reversible treatment of unreduced converter slag in the electric-arc furnace mode. To achieve this, in the first treatment stage, the slag (19) with a high chromium content is melted together with the added charge, the slag is then reduced during the melting process with the silicon and carbon under favorable thermodynamic conditions of the arc, once the slag has reached a minimum temperature of 1,490° C. and the slag is subsequently removed. The air-refining process is then carried out, during which the carbon content is reduced to a value of less than 0.9%. The metal slag (18) is tapped at a tapping temperature of between 1,620 and 1,720° C., the unreduced slag (19) with a high chromium content from the air-refining process remaining in the treatment vessel.

16 Claims, 1 Drawing Sheet

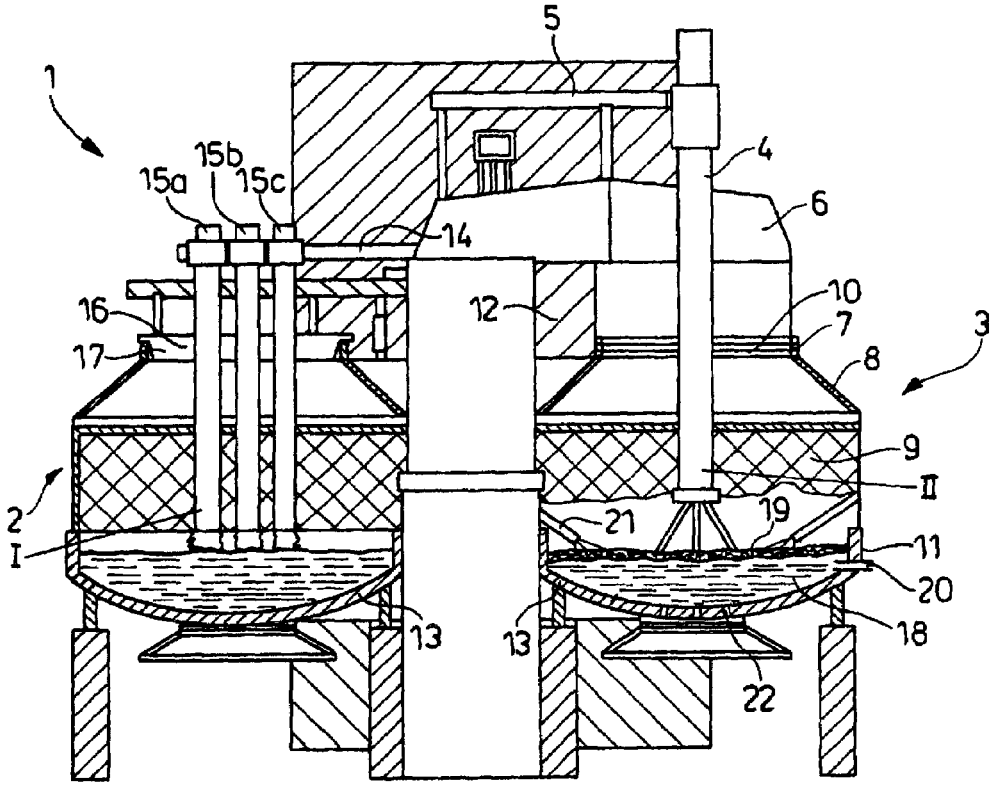
1
5
4
6
15a
15b
15c
14
10
7
3
8
16
17
12
9
II
2
I
21
19
11
20
13
13
18
22

METHOD FOR PRODUCING STAINLESS STEELS, IN PARTICULAR HIGH-GRADE STEELS CONTAINING CHROMIUM AND CHROMIUM-NICKEL

BACKGROUND OF THE INVENTION

1. Field of the Invention

The invention concerns a process for producing stainless steels, especially high-grade steels containing chromium and chromium-nickel.

2. Description of the Related Art

Multistage processes in melting equipment that comprises at least two vessels are well known for the production of high-grade steels that contain chromium or chromium-nickel. Depending on the particular process technology, decarbonization is carried out down to carbon contents of less than 0.3%. There is always a high energy requirement, and temperature losses are unavoidable.

A process of this type is known from DE 196 21 143. The process described there is carried out in melting equipment that comprises at least two vessels. The two vessels are operated in parallel in such a way that alternately either electrodes can be used for melting the charge or blowing lances can be used for top blowing and/or injection of oxygen and oxygen mixtures. The vessels are thus used first as melting equipment and then as decarbonization equipment. After the blowing, the slag is reduced with reducing agents, such as ferrosilicon, aluminum, or secondary aluminum, with the addition of fluxes, such as lime and fluorite, for the recovery of oxidized chromium, and the slag is then tapped. The goal of the invention is to make a process of this type more economical.

The essence of the invention is the reversible treatment of unreduced converter slag in electric-arc furnace operation. In contrast to the well-known process, in which the reduction of the high-chromium slag and thus the recovery of the metallic chromium is carried out in a process step that follows, and is separate from, the melting and oxygen blowing, in this case the reduction is carried out simultaneously with a renewed melting operation of a new charge with retention of the slag of the preceding air-refining process in the vessel. In this way, a process step, namely, the subsequent reduction of the slag, is saved, and the chromium-containing slag is not removed from the system. All together, this makes the process simpler and more economical.

SUMMARY OF THE INVENTION

In detail, the following steps are carried out:

(a) heating of high-chromium slag in the first treatment step together with the melting down of the added charge, specifically, by electric energy from the electric arc;

(b) reduction of the high-chromium slag during the melting process with the silicon and carbon under favorable thermodynamic conditions of the arc, after the melt has reached a minimum temperature of 1,490° C., with subsequent removal of the slag;

(c) treatment of the melt in the same vessel with an air-refining process, in which the blowing of oxygen or oxygen mixtures through top lances, side lances, side below-bath tuyeres, side tuyeres, bottom tuyeres, or porous plugs, individually or in combination, results in the melt being decarbonized to a carbon value of <0.9%, and preferably <0.4%, and heated to a tapping temperature of 1,620 to 1,720°;

(d) thorough mixing of the melt with an inert gas, which is introduced through top lances, side lances, side below-bath tuyeres, side tuyeres, bottom tuyeres, or porous plugs, individually or in combination;

(e) injection/top blowing of alloying agents, fluxes, reducing agents, metal oxide/metal-containing dusts or mixtures through top lances, side lances, side below-bath tuyeres, side tuyeres, bottom tuyeres, or porous plugs, individually or in combination; and (f) subsequent tapping of the melt, during which the unreduced high-chromium slag of the air-refining process remains in the treatment vessel and is reduced in the next cycle of the electric-arc melting process in accordance with step (a).

The proposed process can basically be carried out in a single metallurgical vessel. To accelerate the tapping times, it is proposed, that the process be carried out with two alternately operated metallurgical vessels. In this case, while the decarbonizing blowing of the charge is being carried out in the first treatment vessel, the melting process of a second charge, including the reduction process of the slag, is being carried out at the same time in the second The melting operation may also be carried out by means other than electric arcs, although it is important to make sure that the favorable thermodynamic conditions for the reduction of the slag are maintained.

The blowing of oxygen or oxygen mixtures is preferably carried out in the form of top blowing or side blowing. For the purpose of more thorough mixing and homogenization of the melt, inert gases can be blown in at the same time that the oxygen blowing process is being performed.

At an oxygen blowing time of 20 to 40 minutes, the melt is decarbonized to a final carbon content of <0.9%, and preferably <0.4%.

During the oxygen blowing, coolants are added, for example, in the form of Ni, FeNi, ferrochromium, scrap, and other iron-containing metallic raw materials, such as pigs, DRI, or alloying agents, to reach the target temperature.

In accordance with a preferred process step, the air-refining process is ended at a carbon content of less than or equal to 0.9%, preferably less than or equal to 0.4%, and a temperature of more than 1,680° C., and the molten metal is tapped into the ladle. In accordance with the invention, the slag remains in the vessel, in which it is then reduced during the renewed melting operation. Separately from this, in the further course of treatment, the molten metal is brought to the desired final carbon content of <0.1% by a secondary metallurgical treatment, preferably vacuum degassing. This also has the advantage of protecting the refractory material of the vessel, which is extremely stressed during an air-refining process down to low carbon contents.

In accordance with the invention, the high-chromium slag is reduced with the silicon or carbon from silicon-containing or carbon-containing alloy carriers in the charge. In accordance with an especially preferred variation of the process, it is proposed that additional carbon and possibly silicon be added. The chromium oxide contained in the high-chromium slag is directly reduced to metallic chromium by the carbon and the silicon.

During the melting down of the charge, oxygen or oxygen mixtures are added through top lances, side below-bath tuyeres, side tuyeres, bottom tuyeres, or porous plugs, individually or in combination, to improve silicon and carbon oxidation.

BRIEF DESCRIPTION OF THE DRAWING

Additional details and advantages of the invention are apparent from the following description, in which the embodiment of melting equipment for the process of the invention, which is shown in the drawing, in this case with two metallurgical vessels, is explained in greater detail. In this regard, besides the combinations of features enumerated above, features alone or in other combinations are also included in the invention. The single drawing shows a side view of melting equipment with two treatment vessels.

DETAILED DESCRIPTION OF THE INVENTION

The melting equipment 1 consists of two treatment vessels 2, 3, in which an electric-arc furnace process (I) and an air-refining process (II) are alternately operated. In the left treatment vessel 2, the operating state of melting by electric arcs is shown, and in the right treatment vessel 3, the operating state of decarbonization or oxygen blowing for reducing the carbon content of the melt is shown.

For the oxygen blowing, a lance bracket 5 supports a lance 4, which runs coaxially to the main axis of the vessel through an exhaust gas manifold 6 and the roof center opening 7 of an inclined roof 8 of the right treatment vessel 3 and into the interior of the upper part 9 of the vessel. The mouth 10 of the exhaust gas manifold 6 rests on the roof center opening 7 of the roof 8. The upper part 9 and the lower part 11 together form the furnace vessel 3. The exhaust gas manifold 6 can be swung horizontally by a slewing mechanism 12 to the adjacent treatment vessel 2. The lower part 11 has a taphole 13 for the molten metal, here for bottom tapping, while the chromium-containing slag remains in the vessel.

In the bottom or in the wall of the vessel, there are, individually or in combination, bottom tuyeres 22, porous plugs, side below-bath tuyeres, side tuyeres 20, and/or side lances 21, through which the oxygen, inert gas, and/or gas mixtures are blown.

The treatment vessel 2 shown on the left has an electrode arm 14 that can be swung horizontally, on which, in the present case, three electrodes 15*a, b, c* are mounted, which pass through the roof center 16 of the left treatment vessel 2, which closes the roof center opening 17.

After the molten metal 18 in one treatment vessel has been tapped through the taphole 13, a new melting operation is begun. The tapped melt is conveyed to a steel casting plant or a secondary metallurgical treatment plant (not shown). Material is charged onto the untapped slag 19 remaining in the vessel; the charge contains especially carbon-containing and silicon-containing raw materials, and the entire contents are then melted down. During the melting process, the high-chromium slag is reduced, after the melt has reached a minimum temperature of 1,490° C. After a minimum temperature of preferably 1,550° C. has been reached, the slag is removed, and the melt is subjected to an air-refining process, which causes the melt to be decarbonized down to a carbon content of <0.9%, and preferably <0.4%, and heated to a tapping temperature of 1,620 to 1,720° C. To this end, the electrode arm 14 is swung out, and the oxygen lance 4 is swung in. Then only the molten metal is tapped. The lance 4 is moved out, and the process starts over again. In the adjacent treatment vessel, this operation is carried out by shifting over time.

The invention claimed is:

1. A process for producing stainless steel, especially steel containing chromium and chromium-nickel, using melting equipment including a metallurgical vessel for supplying a steel casting plant, the process including operating an electric-arc furnace process and an air-refining process in the vessel, and, in a first treatment steps in which the electric-arc process is carried out, melting down a charge that is essentially composed of solid and/or molten pig iron and raw materials, especially scrap and in part alloy carriers that contain carbon and silicon, and subsequently decarbonizing the melt, the process comprising a reversive treatment of unreduced slag after the air-refining process in the electric-arc furnace operation comprising the steps of:

(a) heating high-chromium slag in the first treatment step together with melting down the charge;

(b) reducing the high-chromium slag during the melting process with silicon and carbon under favorable thermodynamic conditions of the arc after the melt has reached a minimum temperature of 1,490° C., and subsequently removing the slag;

(c) treating the melt in the same vessel with an air-refining process in which oxygen or oxygen mixtures are blown through top lances, side lances, side below-bath tuyeres, side tuyeres, bottom tuyeres, or porous plugs, individually or in combination, so as to decarbonize the melt to a carbon value of <0.9% and heating the melt to a tapping temperature of 1,620–1,720° C.;

(d) thoroughly mixing the melt with an inert gas introduced through top lances, side lances, side below-bath tuyeres, side tuyeres, bottom tuyeres, or porous plugs, individually or in combination;

(e) injecting or top-blowing of alloying agents, fluxus, reducing agents, metal oxides/metal-containing dusts, or mixtures thereof through top lances, side lances, side below-bath tuyeres, side tuyeres, bottom tuyeres, or porous plugs, individually or in combination; and (f) subsequently tapping the melt such that unreduced high-chromium slag of the air-refining process remains in the treatment vessel and is reduced in a next cycle of the electric-arc melting process in accordance with step (a);

terminating the air-refining process at a carbon content of less than 0.9% and a temperature of more than 1,680 W, emptying the molten metal into a ladle, while the slide remains in the vessel, and carrying out a secondary metallurgical treatment in which the molten metal is brought to a desired final carbon content of less than 0.1%.

2. A process for producing stainless steel, especially steel containing chromium and chromium-nickel, using melting equipment including at least two vessels for supplying a steel casting plant, the process including alternately upright-ing an electric-arc furnace process and an air-refining process in both vessels, and, in a first treatment step in which the electric-arc melting process is carried out, melting down a charge composed essentially of solid and/or molten pig iron and raw materials, especially scrap, and partially alloy carriers containing carbon and silicon, and carbonizing the melt, and wherein, simultaneously with decarbonizing blowing of the charge in the first treatment vessel, carry out the melting process of a second charge in the second treatment vessel, the process comprising a reversive treatment of unreduced slag after the air-refining process in the electric-arc furnace operation comprising the steps of:

(a) heating of high-chromium slag in the first treatment step together with the melting down of the added charge;

(b) reduction of the high-chromium slag during the melting process with the silicon and carbon under favorable thermodynamic conditions of the arc, after the melt has reached a minimum temperature of 1,490° C., with subsequent removal of the slag;

(c) treatment of the melt in the same vessel with an air-refining process, in which the blowing of oxygen or oxygen mixtures through top lances, side lances, side below-bath tuyeres, side tuyeres, bottom tuyeres, or porous plugs, individually or in combination, results in the melt being decarbonized to a carbon value of <0.9% and heated to a tapping temperature of 1,620 to 1,720° C.;

(d) thorough mixing of the melt with an inert gas, which is introduced through top lances, side lances, side below-bath tuyeres, side tuyeres, bottom tuyeres, or porous plugs, individually or in combination;

(e) injection/top blowing of alloying agents, fluxes, reducing agents, metal oxide/metal-containing dusts, or mixtures through top lances, side lances, side below-bath tuyeres, side tuyeres, bottom tuyeres, or porous plugs, individually or in combination;

(f) subsequent tapping of the melt, during which the unreduced high-chromium slag of the air-refining process remains in the treatment vessel and is reduced in the next cycle of the electric-arc melting process in accordance with step (a); and (g) wherein, simultaneously with decarbonizing blowing of the charge in the first treatment vessel, carrying out the melting process of a second charge, including the reduction process of the slag, in the second treatment vessel.

3. The process in accordance with claim 1, comprising effecting blowing of oxygen or oxygen mixtures through top lances, side lances, side below-bath tuyeres, side tuyeres, bottom tuyeres, or porous plugs, individually or in combination, by top blowing and/or injection.

4. The process in accordance with claim 1, for thoroughly mixing and homogenizing the melt, blowing the inert gas in at the same time as the oxygen blowing process through top lances, side lances, side below-bath tuyeres, side tuyeres, bottom tuyeres, or porous plugs, individually or in combination.

5. The process in accordance with claim 1, comprising, during oxygen blowing for a time of 20 to 40 minutes, decarbonizing the melt to a final carbon content of <0.9%.

6. The process in accordance with claim 1, comprising adding coolants during oxygen blowing.

7. The process in accordance with claim 1, comprising adding additional carbon and/or silicon and/or other reducing agents.

8. The process in accordance with claim 1, comprising directly reducing the chromium oxide and other metals oxide contained in the high-chromium slag to metallic chromium and other metals by the carbon and the silicon.

9. The process in accordance with claim 1, comprising, during melting down of the charge, adding oxygen for the oxidation of silicon and carbon through top lances, side lances, side below-bath tuyeres, side tuyeres, bottom tuyeres, or porous plugs, individually or in combination.

10. The process in accordance with claim 2, comprising effecting blowing of oxygen or oxygen mixtures through top lances, side lances, side below-bath tuyeres, side tuyeres, bottom tuyeres, or porous plugs, individually or in combination, by top blowing and/or injection.

11. The process in accordance with claim 2, for thoroughly mixing and homogenizing the melt, blowing the inert gas in at the same time as the oxygen blowing process through top lances, side lances, side below-bath tuyeres, side tuyeres, bottom tuyeres, or porous plugs, individually or in combination.

12. The process in accordance with claim 2, comprising, during oxygen blowing for a time of 20 to 40 minutes, decarbonizing the melt to a final carbon content of <0.9%.

13. The process in accordance with claim 2, comprising adding coolants during oxygen blowing.

14. The process in accordance with claim 2, comprising adding additional carbon and/or silicon and/or other reducing agents.

15. The process in accordance with claim 2, comprising directly reducing the chromium oxide and other metals oxide contained in the high-chromium slag to metallic chromium and other metals by the carbon and the silicon.

16. The process in accordance with claim 2, comprising, during melting down of the charge, adding oxygen for the oxidation of silicon and carbon through top lances, side lances, side below-bath tuyeres, side tuyeres, bottom tuyeres, or porous plugs, individually or in combination.

* * * * *